US006848507B2

(12) United States Patent
Huggins et al.

(10) Patent No.: US 6,848,507 B2
(45) Date of Patent: Feb. 1, 2005

(54) EXPANDABLE WIREFINDER AND METHOD FOR USE OF SAME

(75) Inventors: Jeffry W. Huggins, Grapevine, TX (US); Robert L. Thurman, Carrollton, TX (US)

(73) Assignee: Malliburton Energy Services, Inc., Houston, TX (US)

( * ) Notice: Subject to any disclaimer, the term of this patent is extended or adjusted under 35 U.S.C. 154(b) by 198 days.

(21) Appl. No.: 10/217,679

(22) Filed: Aug. 13, 2002

(65) Prior Publication Data

US 2004/0031604 A1 Feb. 19, 2004

(51) Int. Cl.[7] ..... E21B 31/18
(52) U.S. Cl. ..... 166/301; 166/98; 294/86.11
(58) Field of Search ..... 166/301, 98; 294/86.1, 294/86.11, 86.24, 86.26

(56) References Cited

U.S. PATENT DOCUMENTS 6,622,789 B1 * 9/2003 Braddick ..... 166/277

OTHER PUBLICATIONS

*Standard Wireline Tools Catalog Parts 1–8*; B.D. Kendle, Engineering Limited, www.bdkendle.co.uk. *Online Product Catalog*; Wireline Engineering Ltd., www.wireline–eng-.co.uk.

* cited by examiner

*Primary Examiner*—William Neuder
(74) *Attorney, Agent, or Firm*—Lawrence R. Youst

(57) ABSTRACT

An expandable wirefinder (60) for locating a wire downhole comprises a sleeve (62) and a dual collet assembly (72). The dual collet assembly (72) has first and second collet members (78, 82) each having plurality of collet fingers (80, 84). The dual collet assembly (72) is slidable relative to the sleeve (62) to operate between running and finding positions. In the running position, the first collet member (78) is partially disposed within the sleeve (62) with its collet fingers (80) inwardly radially biased by the sleeve (62) and the second collet member (82) is disposed within the first collet member (78) with its collet fingers inwardly (84) radially biased by the sleeve (62). In the finding position, the collet fingers (80) of the first collet member (78) radially expand to form gaps therebetween and the collet fingers (84) of the second collet member (82) radially expand into the gaps.

45 Claims, 5 Drawing Sheets

10
12
14
16
18
20
22
24
26
28
30
32
34
36
38
40
42
44
46
48
50

EXPANDABLE WIREFINDER AND METHOD FOR USE OF SAME

TECHNICAL FIELD OF THE INVENTION

This invention relates, in general, to finding the end of a broken wireline disposed within a wellbore and, in particular, to an expandable wirefinder capable of traveling through a restriction within the wellbore then expanding to the diameter of the wellbore to find the end of the broken wireline and a method for use of the same.

BACKGROUND OF THE INVENTION

Once a well that traverses a subterranean hydrocarbon bearing formation has been drilled, it is common to attach a variety of tools or equipment to the end of a conductive or nonconductive wireline and lower the tools or equipment downhole to perform wireline operations. For example, certain flow control devices such as subsurface safety valves, plugs, packers, gas lift valves and the like are commonly lowered into the wellbore or retrieved from the wellbore via wireline. Similarly, certain downhole devices such as sliding sleeves and the like are commonly actuated using a service tool suspended on a wireline.

During any of the above wireline operations, there is always a risk that the wireline may break during the operation. For example, the weight of the tool string sometimes exceeds the breaking strength of the wireline. Alternatively, if the tool string may become stuck in the wellbore, it may be necessary to pull on the wireline to release the tool string. Such excessive tension on the wireline may cause the wireline to break. In addition, in the case of detonating a perforating gun, the shock generated by the perforating gun will sometimes cause the wireline to break. Furthermore, if an out of range pressure condition occurs during a wireline operation, it may be necessary to shut in the well at a set of shear rams or at a subsurface safety valve. In either case, the wireline may be cut during the shut in operation.

When such a wireline break occurs, it becomes necessary to find and retrieve the broken wireline from the wellbore. It has been found, however, that it is often difficult to find and retrieve the broken wireline as the wireline typically falls down into the wellbore and coils up against the interior wall of the wellbore. In addition, finding and retrieving such as broken wireline is particularly difficult when a wellbore restriction is present uphole of the broken wireline.

Therefore, a need has arisen for a tool that is capable of finding the end of a wireline after the wireline has broken downhole. A need has also arisen for such a tool that can pass through a restriction in the wellbore yet still find the end of the broken wireline. Further, a need has arisen for such a tool that allows for the retrieval of the broken wireline after the end of the wireline has been found.

SUMMARY OF THE INVENTION

The present invention disclosed herein comprises an expandable wirefinder and a method for using an expandable wirefinder that is capable of finding the end of a wireline after the wireline has broken downhole. The expandable wirefinder of the present invention can pass through a restriction in the wellbore yet still find the end of the broken wireline. In addition, the expandable wirefinder of the present invention allows for the retrieval of the broken wireline after the end of the wireline has been found.

The expandable wirefinder comprises a sleeve and a dual collet assembly that includes first and second collet members. Each of the collet members has plurality of collet fingers. The dual collet assembly is slidably moveable relative to the sleeve between a running position and a finding position. In the running position, the first collet member is partially disposed within the sleeve with its collet fingers inwardly radially biased by the sleeve and the second collet member is disposed within the first collet member with its collet fingers inwardly radially biased by the sleeve. In the finding position, the collet fingers of the first collet member radially expanded to form gaps therebetween and the collet fingers of the second collet member radially expanded into the gaps between the collet fingers of the first collet member.

More specifically, when the dual collet assembly is in the running position, the ends of the collet fingers of the first collet member form a circular configuration having a diameter substantially the same as a diameter of the sleeve. At the same time, the ends of the collet fingers of the second collet member substantially form a circular configuration having a diameter less than a diameter of the sleeve.

Also, when the dual collet assembly is in the finding configuration, the ends of the collet fingers of the first collet member substantially form a gapped circular configuration having a diameter larger than the diameter of the sleeve. Likewise, the ends of the collet fingers of the second collet member substantially form a gapped circular configuration having a diameter substantially the same as the diameter of the ends of the collet fingers of the first collet member. Accordingly, the expandable wirefinder of the present invention can be run downhole and pass through a restriction then expand to the diameter of the tubular in which the broken wireline in located.

In one embodiment of the expandable wirefinder of the present invention, the expandable wirefinder is used to locate the end of the broken wireline downhole then reconfigure the end of the broken wireline by bending the wireline, creating one or more loops in the broken wireline and moving the end of the broken wireline away from the inner surface of the tubular. This embodiment of the expandable wirefinder of the present invention is then pulled out of the hole and a wire grab is run into the hole to retrieve the reconfigured broken wireline from the known position.

In another embodiment of the expandable wirefinder of the present invention, the expandable wirefinder includes its own wire grab such that the locating and retrieving of the broken wireline may occur during the same trip downhole.

In another aspect of the present invention, the expandable wirefinder is operated in accord with a method comprising the steps of running an expandable wirefinder downhole on a conveying device, the expandable wire finder including a sleeve and a dual collet assembly with a wire grab, contacting a restriction downhole with the sleeve, operating the dual collet assembly from a running position to a finding position, proceeding farther downhole with the dual collet assembly in the finding position, finding the wire downhole with the dual collet assembly, grabbing the wire with the wire grab, retrieving the dual collet assembly and the wire uphole to the sleeve, operating the dual collet assembly from the finding position to the running position and retrieving the expandable wirefinder and the wire uphole.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
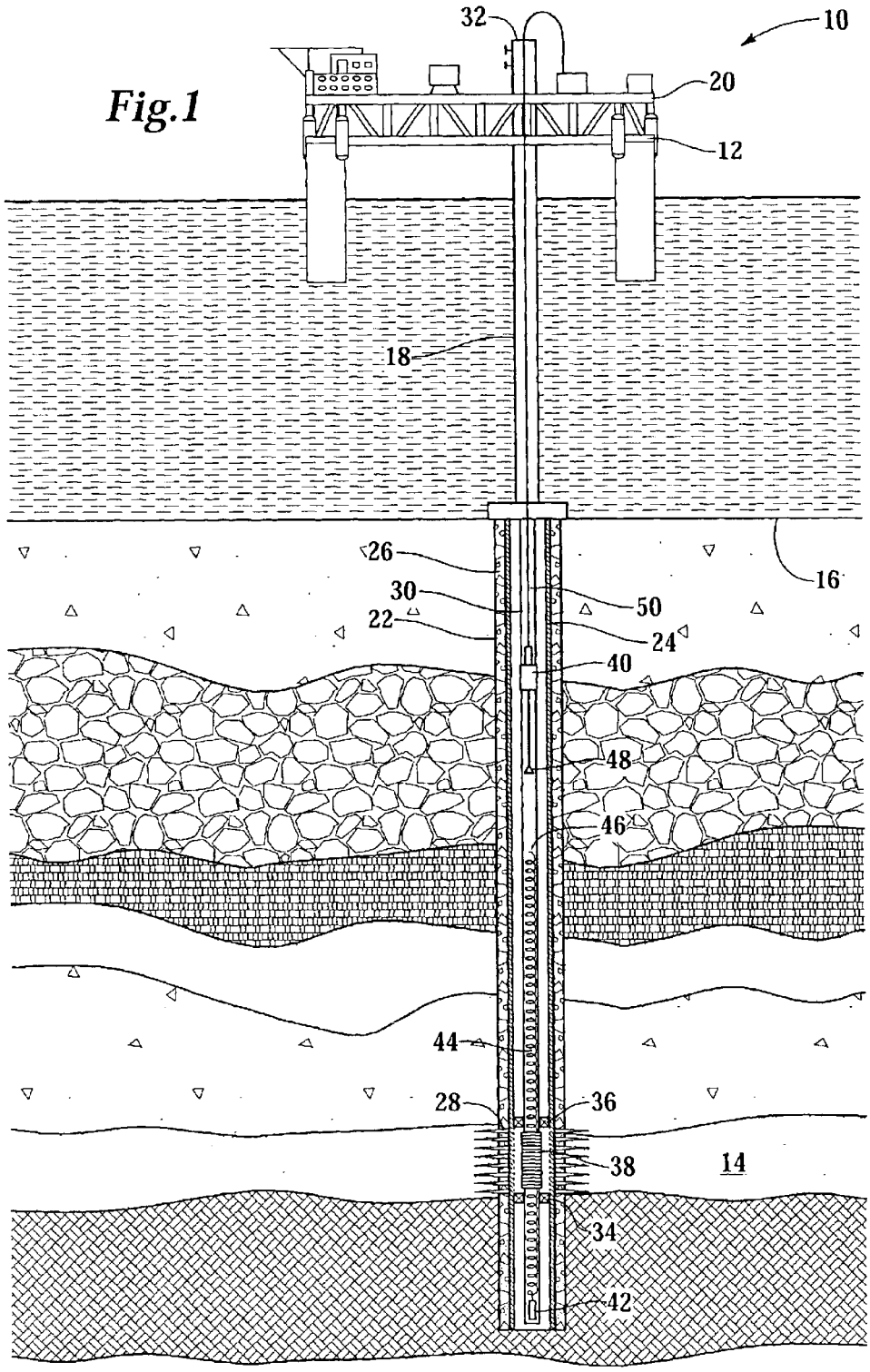
FIG. 1 is a schematic illustration of an offshore oil and gas platform operating an expandable wirefinder according to the present invention.

Referring initially to FIG. 1, an expandable wirefinder of the present invention for locating the end of a wireline that has broken downhole is being operated from an offshore oil and gas platform that is schematically illustrated and generally designated 10. A semi-submersible platform 12 is centered over a submerged oil and gas formation 14 located below sea floor 16. A subsea conductor 18 extends from deck 20 of platform 12 to sea floor 16. A wellbore 22 extends from sea floor 16 and traverse formation 14. Wellbore 22 includes a casing 24 that is cemented therein by cement 26. Casing 24 has perforations 28 in the interval proximate formation 14.

A tubing string 30 extends from wellhead 32 to formation 14 to provide a conduit for production fluids to travel to the surface. A pair of packers 34, 36 provide a fluid seal between tubing string 30 and casing 24 and direct the flow of production fluids from formation 14 through sand control screen 38. Disposed within tubing string 30 is a subsurface safety valve 40 that is designed to shut in the flow of production fluids if the flow exceeds a preset rate. Also disposed within tubing string 30 is a wireline operated pressure testing tool 42 that is attached on the far end of a broken wireline 44. The near end 46 of wireline 44 is positioned against the interior surface of tubing string 30 as wireline 44 has coiled up within tubing string 30 after being cut by subsurface safety valve 40 during an out of range condition that occurred during a pressure testing operation.

In the illustrated embodiment, a fishing operation is being conducted wherein expandable wirefinder 48 is being run downhole on a conveyance 50, such as a wireline, coiled tubing or the like, to find near end 46 of broken wireline 44. As explained in greater detail below, expandable wirefinder 48 is not only capable of passing through the restriction crated by subsurface safety valve 40, but is also capable of contacting the interior surface of tubing string 30 beyond the restriction such that near end 46 of broken wireline 44 may be found and wireline 44 including pressure testing tool 42 can subsequently be retrieved.

Figure 2:
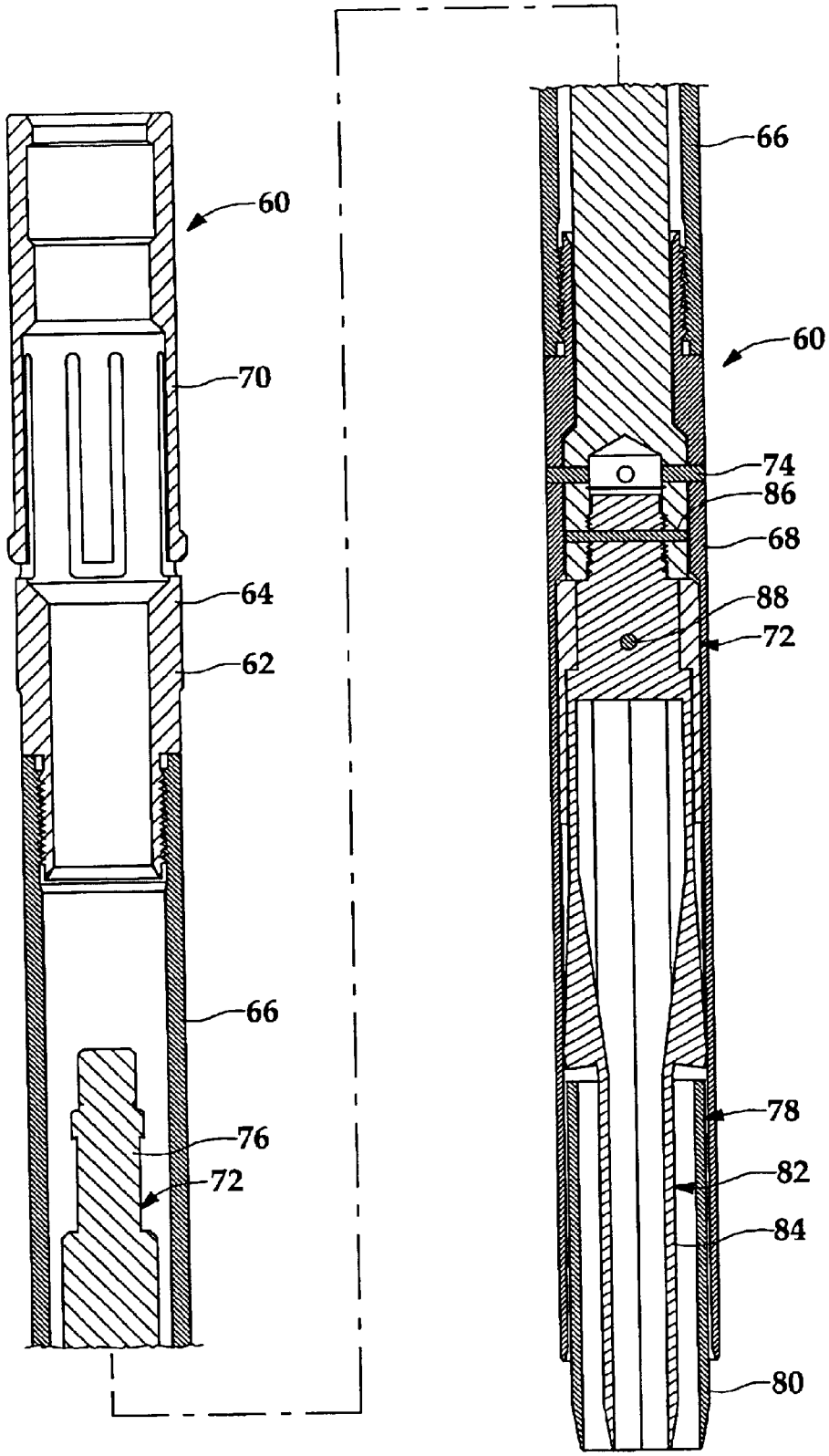
FIG. 2 is a half sectional view of an expandable wirefinder according to the present invention in its running position.

Referring next to FIG. 2, therein is depicted an expandable wirefinder of the present invention that is generally designated 60. Expandable wirefinder 60 includes an axially extending generally tubular sleeve 62. Sleeve 62 includes an upper sleeve section 64, a middle sleeve section 66 that is threadably coupled to upper sleeve section 64 and a lower sleeve section 68 that is threadably coupled to middle sleeve section 66. Upper sleeve section 64 has a profile 70 that is used to latch into a matching profile within a downhole restriction such as the receiving profile within a subsurface safety valve.

Positioned within sleeve 62 is a dual collet assembly 72. Dual collet assembly 72 is initially coupled to lower sleeve section 68 by a plurality of shear pins 74. Dual collet assembly 72 has a fish neck 76 that is used to couple dual collet assembly 72 to a conveyance. Dual collet assembly 72 includes an outer collet member 78 having a plurality of collet fingers 80 and an inner collet member 82 having a plurality of collet fingers 84. In the illustrated embodiment, inner collet member 82 is coupled to fish neck 76 with a pin connector 86. Also, in the illustrated embodiment, outer collet member 78 is coupled to inner collet member 82 with a pin connector 88. It should be understood by those skilled in the art that other types of connections may be made between inner collet member 82 and fish neck 76 and between outer collet member 78 and inner collet member 82, such as threaded connections, without departing from the principles of the present invention.

Figure 3:
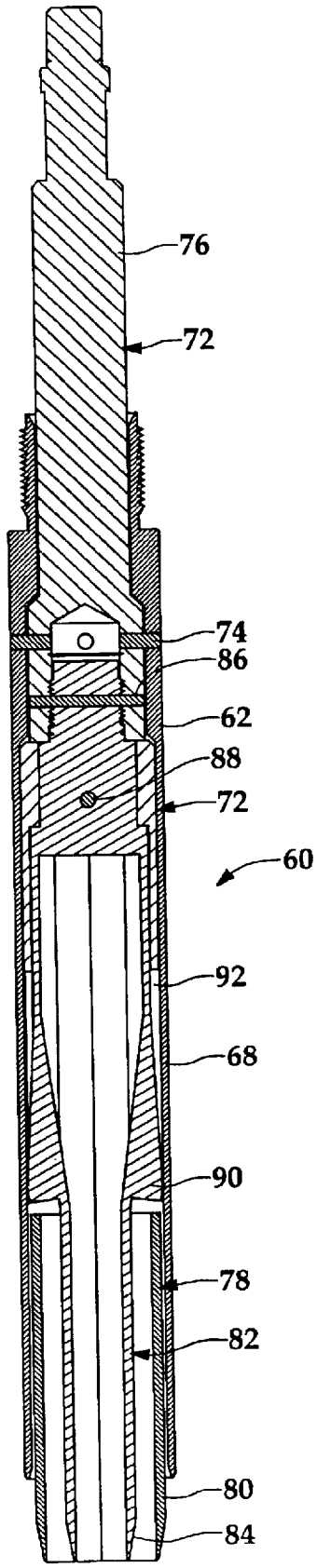
FIG. 3 is a half sectional view of an expandable wirefinder according to the present invention in its running position.
Figure 4:
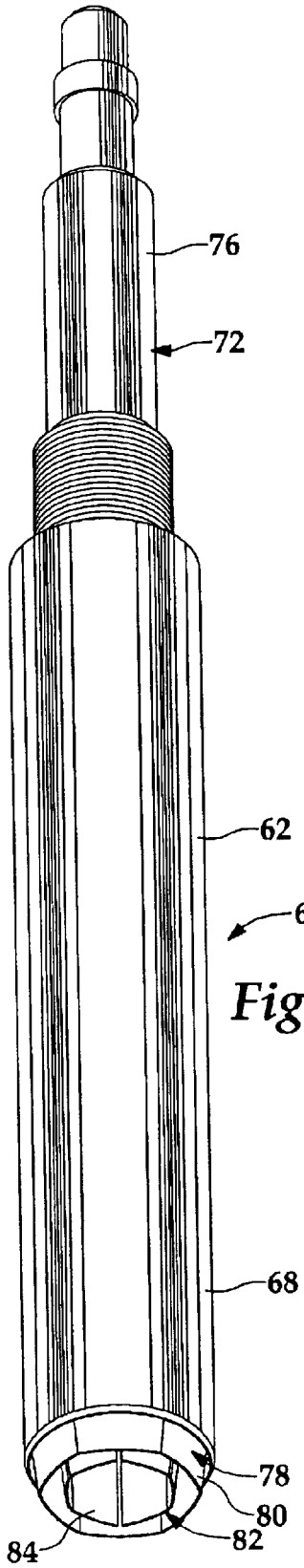
FIG. 4 is a perspective view of an expandable wirefinder according to the present invention in its running position.

Referring now to FIGS. 3 and 4, dual collet assembly 72 has a running position wherein outer collet member 78 is at least partially disposed within lower sleeve section 68 and inner collet member 82 is disposed within outer collet member 78. More specifically, in this running position, collet fingers 80 of outer collet member 78 are inwardly radially biased by lower sleeve section 68 such that collet fingers 80 form a substantially cylindrical configuration. In fact, as best seen in FIG. 4, the ends of collet fingers 80 substantially form a circular configuration having a diameter substantially the same as a diameter of sleeve 62. Accordingly, in the running position, outer collet member 78 can pass through a variety of restrictions within a wellbore including the restriction having the profile that matches profile 70 of upper sleeve section 64.

Also in the running position of dual collet assembly 72, collet fingers 84 of inner collet member 82 are inwardly radially biased by lower sleeve section 68 such that collet fingers 84 form a substantially cylindrical configuration. More specifically, each collet finger 84 has a radially outwardly extending lug 90 the passes through a respective window 92 of outer collet member 78 and contacts the interior surface of lower sleeve section 68. Due to the thickness of lugs 90, collet fingers 84 of inner collet member 82 are biased radially inwardly to a location within outer collet member 78. In fact, as best seen in FIG. 4, the ends of collet fingers 84 substantially form a circular configuration having a diameter smaller than the diameter of the substantially circular configuration of the ends of collet fingers 80 of outer collet member 78.

Figure 5:
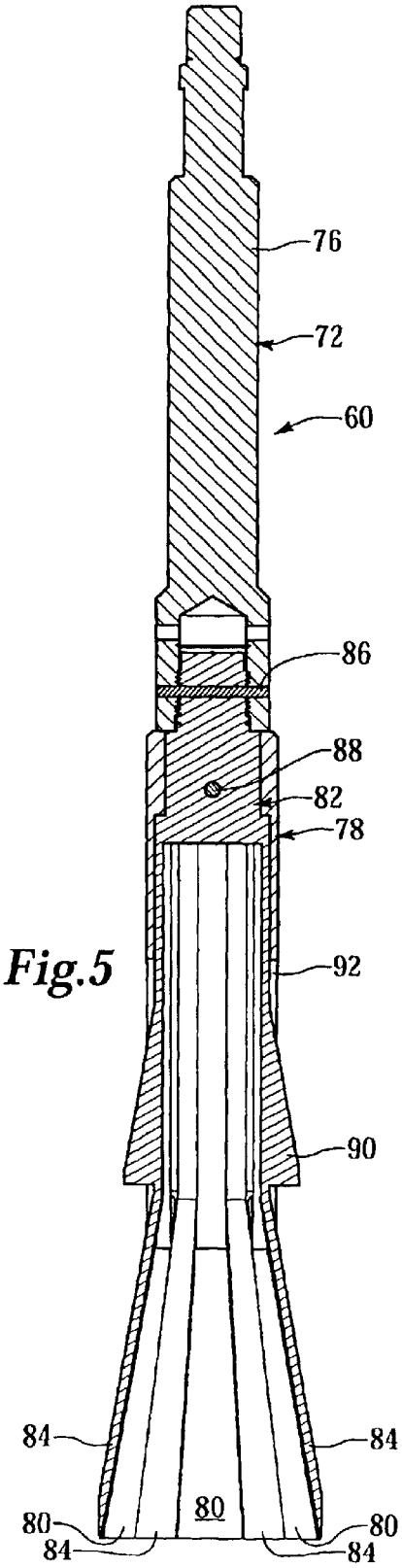
FIG. 5 is a half sectional view of an expandable wirefinder according to the present invention in its finding position.
Figure 6:
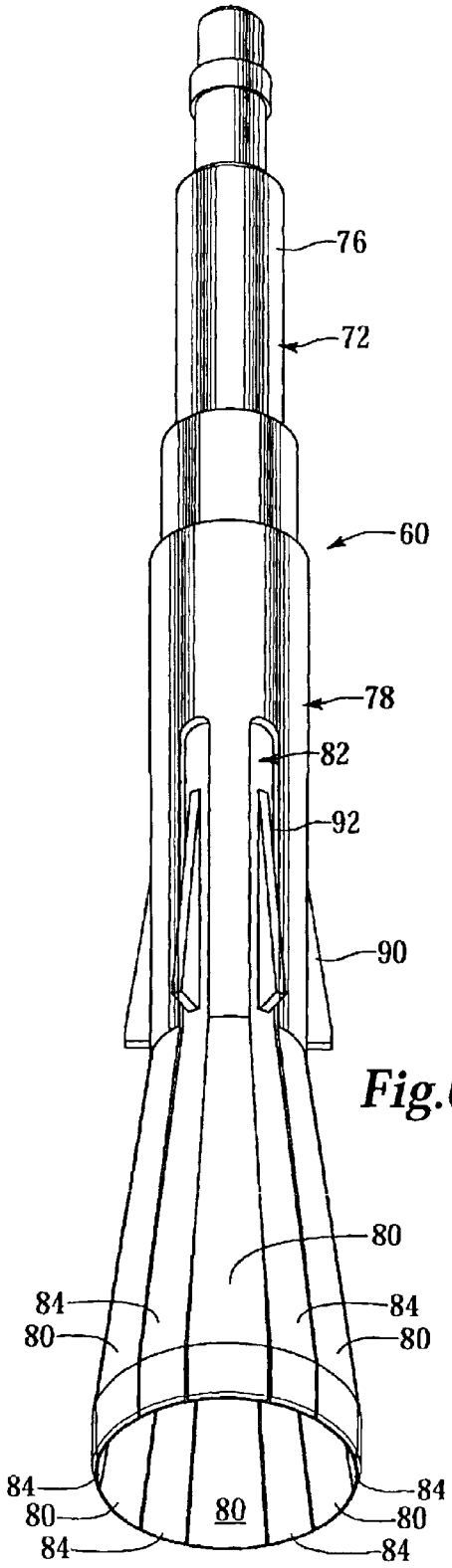
FIG. 6 is a perspective view of an expandable wirefinder according to the present invention in its finding position.

Referring now to FIGS. 5 and 6, dual collet assembly 72 has a finding position wherein dual collet assembly 72 has been released from sleeve 62 by shearing shear pins 74 after profile 70 of upper sleeve section 64 has located its matching profile in the downhole restriction. In the finding position, outer collet member 78 is no longer disposed within lower sleeve section 68. Accordingly, collet fingers 80 of outer collet member 78 are no longer inwardly radially biased by lower sleeve section 68. Instead, collet fingers 80 of outer collet member 78 substantially form a conical section having gaps between collet fingers 80. In fact, as best seen in FIG. 6, the ends of collet fingers 80 of outer collet member 78 substantially form a gapped circular configuration having a diameter larger than the diameter of sleeve 62.

Also in the finding position of dual collet assembly 72, collet fingers 84 of inner collet member 82 are no longer inwardly radially biased by lower sleeve section 68. Instead, collet fingers 84 of inner collet member 82 also substantially form a conical section having gaps between collet fingers 84. In fact, as best seen in FIG. 6, the ends of collet fingers 84 of inner collet member 82 substantially form a gapped circular configuration having a diameter substantially the same as the diameter of the gapped circular configuration of the ends of collet fingers 80 of outer collet member 78.

In the finding position of dual collet assembly 72, collet fingers 84 of inner collet member 82 fill the gaps between collet fingers 80 of outer collet member 78 and collet fingers 80 of outer collet member 78 fill the gaps between collet fingers 84 of inner collet member 82. Accordingly, when the diameter at the ends of collet fingers 84 of inner collet member 82 and collet fingers 80 of outer collet member 78 is substantially the same as the inner diameter of the tubular in which the broken wireline is disposed, the end of the broken wireline will be contacted by dual collet assembly 72 of expandable wirefinder 60 even when the end of the broken wireline is in contact with the inner surface of the tubular. As little or no gap is present between collet fingers 84 of inner collet member 82 and collet fingers 80 of outer collet member 78, the end of the broken wireline cannot elude dual collet assembly 72 of expandable wirefinder 60.

Furthermore, due to the conical shape of the interior of dual collet assembly 72 in the finding position, when the end of the broken wireline is found, the end can be bent over such that the end will no longer be in contact with the inner surface of the tubular and a conventional wire grab tool may be run downhole on a subsequent wireline trip to grab the end of the broken wireline and retrieve the broken wireline along with any tools attached to the lower end of the broken wireline to the surface.

Even though FIGS. 2–6 have depicted expandable wirefinder 60 as having six collet fingers 80 in outer collet member 78 and six collet fingers 84 in outer collet member 82, it should be understood by those skilled in the art that outer collet member 78 and inner collet member 82 could alternative have other numbers of collet fingers either greater than or less than six without departing from the principles of the present invention.

In operation, dual collet assembly 72 is pinned within sleeve 62 such that outer collet member 78 is at least partially disposed within lower sleeve section 68 and inner collet member 82 is disposed within outer collet member 78. In this running position, expandable wirefinder 60 may be run downhole on a conveyance such as a wireline. When expandable wirefinder 60 reaches a restriction in the wellbore, such as subsurface safety valve 40 of FIG. 1, dual collet assembly 72 as well as lower sleeve section 68 and middle sleeve section 66 can pass through the restrictions. The downward travel of expandable wirefinder 60 is stopped, however, when profile 70 of upper sleeve section 64 is received within a matching profile within the restriction.

At this point, shear pins 74 are sheared by appropriate axial jarring such that dual collet assembly 72 including fish neck 76, outer collet member 78 and inner collet member 82 is disconnected from sleeve 62. Dual collet assembly 72 is now free to continue its downhole decent as additional length of the conveyance is feed into the well. As dual collet assembly 72 is slidably released from sleeve 62, dual collet assembly 72 shifts from its running position to its finding position. During the shifting process, collet fingers 80 of outer collet member 78 begin to radially expand such that gaps are formed therebetween. Thereafter, collet fingers 84 of inner collet member 82 begin to radially expand such that gaps are formed therebetween. As dual collet assembly 72 nears the fully expanded or finding position, collet fingers 84 of inner collet member 82 fill the gaps between collet fingers 80 of outer collet member 78 and collet fingers 80 of outer collet member 78 fill the gaps between collet fingers 84 of inner collet member 82 leaving no gaps between any of the collet fingers.

In the finding position, collet fingers 84 of inner collet member 82 and collet fingers 80 of outer collet member 78 preferably contact the interior surface of the tubular in which the broken wireline is disposed. Dual collet assembly 72 is then run farther downhole until dual collet assembly 72 contacts the end of the broken wireline. The weight of dual collet assembly 72 and the conveyance are then allowed to act on the end of the broken wireline in, for example, a cyclical manner. Due to the conical interior shape of dual collet assembly 72, this process bends the end of the broken wireline preferably creating one or more loops in the broken wireline and moving the end of the broken wireline away from the inner surface of the tubular and toward the center of the tubular.

Once the end of the broken wireline has been appropriately reconfigured, expandable wirefinder 60 of the present invention may be retrieved to the surface. Specifically, the conveyance is pulled out of the hole until dual collet assembly 72 reaches sleeve 62. As dual collet assembly 72 slidably enters sleeve 62, dual collet assembly 72 shifts from its finding position to its running position. Specifically, lugs 90 of collet fingers 84 of inner collet member 82 contact the end of lower sleeve section 68 which inwardly radially biases collet fingers 84 and retracts collet fingers 84 out of the gaps between collet fingers 80 of outer collet member 78. Further movement of dual collet assembly 72 into sleeve 62 causes collet fingers 80 of outer collet member 78 to contact the end of lower sleeve section 68 which inwardly radially biases collet fingers 80.

Once dual collet assembly 72 has returned to its running position, appropriate tension on the conveyance will cause profile 70 to release from its matching profile in the restriction such that expandable wirefinder 60 may be retrieved to the surface. Thereafter, a suitable wire grab may be attached to the end of the conveyance and run downhole to the known location of the end of the broken wireline which is now in a configuration that is conducive to being caught in the wire grab such that the broken wireline may be retrieved to the surface.

Figure 7:
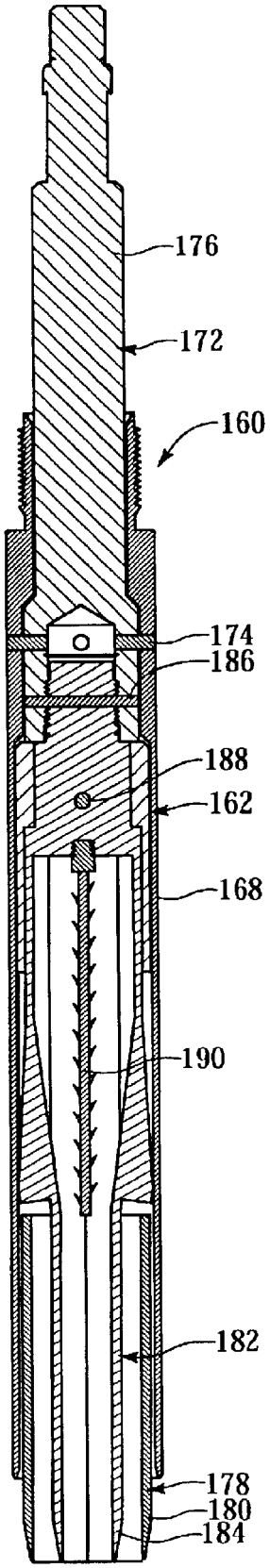
FIG. 7 is a half sectional view of an expandable wirefinder having a wire grab according to the present invention in its running position.
Figure 8:
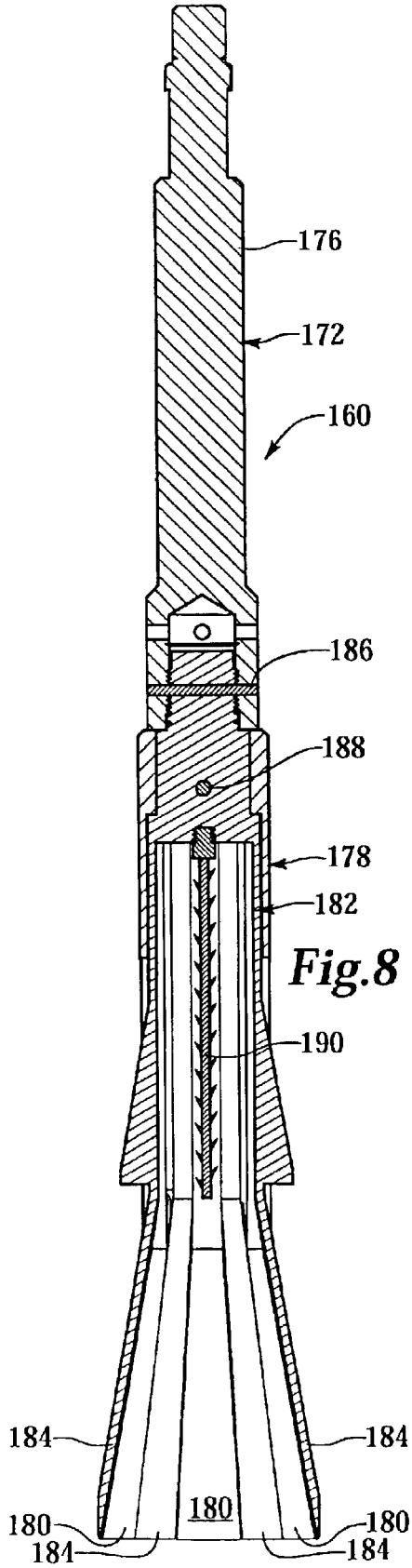
FIG. 8 is a half sectional view of an expandable wirefinder having a wire grab according to the present invention in its finding position.

Referring next to FIGS. 7 and 8, therein is depicted another embodiment of an expandable wirefinder of the present invention in its running position and its finding position, respectively, that is generally designated 160. Expandable wirefinder 160 includes an axially extending generally tubular sleeve 162. Sleeve 162 includes an upper sleeve section (not pictured), a middle sleeve section (not pictured) that is threadably coupled to the upper sleeve section and a lower sleeve section 168 that is threadably coupled to the middle sleeve section. As described above with reference to expandable wirefinder 60 in FIG. 2, the upper sleeve section of expandable wirefinder 160 has a profile that is used to latch into a matching profile within a downhole restriction such as the receiving profile within a subsurface safety valve.

Positioned within sleeve 162 is a dual collet assembly 172. Dual collet assembly 172 is initially coupled to lower sleeve section 168 by a plurality of shear pins 174. Dual collet assembly 172 has a fish neck 176 that is used to couple dual collet assembly 172 to a conveyance. Dual collet assembly 172 includes an outer collet member 178 having a plurality of collet fingers 180 and an inner collet member 182 having a plurality of collet fingers 184. In the illustrated embodiment, inner collet member 182 is coupled to fish neck 176 with a pin connector 186. Also, in the illustrated embodiment, outer collet member 178 is coupled to inner collet member 182 with a pin connector 188.

Expandable wirefinder 160 operates in a manner that is similar to expandable wirefinder 60 described above, except expandable wirefinder 160 carries its own wire grab mechanism depicted herein as a wireline spear 190. In the illustrated embodiment, wireline spear 190 is threadably coupled to inner collet member 182. Wireline spear 190 axially extends into the region surrounded by collet fingers 184 of inner collet member 182 when dual collet assembly 172 is in the running position. When dual collet assembly 172 is in the finding position, wireline spear 190 axially extends into the region surrounded by collet fingers 184 of inner collet member 182 and by collet fingers 182 of outer collet member 178. In this position, once the end of the broken wireline is found and the weight of dual collet assembly 172 and the conveyance are applied on the end of the broken wireline to bend the wireline and create loops, wireline spear 190 can grab the broken wireline such that it can be found and retrieved to the surface in a single trip of expandable wirefinder 160.

Even though expandable wirefinder 160 has been described as having a wireline spear type wire grab, other types of wire grabs such as a pronged U-shaped wire grab, a dog knot type wire grab or the like may alternatively be used in conjunction with expandable wirefinder 160 without departing from the principles of the present invention.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. An expandable wirefinder for locating a wire downhole comprising:

a sleeve;

an outer collet member having a plurality of outer collet fingers, the outer collet member having a running position and a finding position, in the running position, the outer collet member at least partially disposed within the sleeve with the outer collet fingers inwardly radially biased by the sleeve, in the finding position, the outer collet member not being disposed within the sleeve such that the outer collet fingers radially expand creating gaps therebetween; and an inner collet member having a plurality of inner collet fingers each having a lug extending radially outwarding therefrom, the inner collet member having a running position and a finding position, in the running position, the inner collet member being disposed within the outer collet member with the inner collet fingers inwardly radially biased by the sleeve contacting the lugs, in the finding position, the inner collet fingers radially expanding into the gaps between the outer collet fingers, wherein the inner collet fingers retract before the outer collet fingers when the outer collet member and inner collet member are shifted from the finding position to the running position.

2. The expandable wirefinder as recited in claim 1 wherein the outer collet fingers form a substantially cylindrical configuration when the outer collet member is in the running configuration.

3. The expandable wirefinder as recited in claim 1 wherein each of the outer collet fingers has an end, wherein the ends of the outer collet fingers substantially form a circular configuration having a diameter substantially the same as a diameter of the sleeve when the outer collet member is in the running configuration and wherein the ends of the outer collet fingers substantially form a gapped circular configuration having a diameter larger than the diameter of the sleeve when the outer collet member is in the finding configuration.

4. The expandable wirefinder as recited in claim 1 wherein the inner collet fingers form a substantially cylindrical configuration when the inner collet member is in the running configuration.

5. The expandable wirefinder as recited in claim 1 wherein each of the inner collet fingers has an end, wherein the ends of the inner collet fingers substantially form a circular configuration having a diameter less than a diameter of the sleeve when the inner collet member is in the running configuration and wherein the ends of the inner collet fingers substantially form a gapped circular configuration having a diameter larger than the diameter of the sleeve when the inner collet member is in the finding configuration.

6. The expandable wirefinder as recited in claim 1 wherein each of the outer and the inner collet fingers has an end and wherein the ends of the outer and the inner collet fingers substantially form a circular configuration having substantially the same diameter when the outer and the inner collet members are in the finding configuration.

7. The expandable wirefinder as recited in claim 1 wherein relative axial movement between the inner and the outer collet members is prevented.

8. The expandable wirefinder as recited in claim 1 further comprising a fish neck operably associated with the inner and the outer collet members and operably connectable with a conveying tool that axially shifts the inner and the Outer collet members relative to the sleeve, thereby operating the inner and the outer collet members between the running and the finding positions.

9. An expandable wirefinder for locating a wire downhole comprising:

a sleeve; and a dual collet assembly having first and second collet members each having plurality of collet fingers, the dual collet assembly slidably moveable relative to the sleeve between a running position and a finding position, in the running position, the first collet member at least partially disposed within the sleeve with its collet fingers inwardly radially biased by the sleeve and the second collet member disposed within the first collet member with its collet fingers inwardly radially biased by the sleeve, in the finding position, the collet fingers of the first collet member radially expanded to form gaps therebetween and the collet fingers of the second collet member radially expanded into the gaps, wherein each of the collet fingers of the second collet member has a lug extending radially outwardly therefrom such that when the dual collet assembly is in the running configuration, the lugs contact the sleeve, thereby inwardly radially biasing the collet fingers of the second collet member and such that the collet fingers of the second collet member retract before the collet fingers of the first collet member when the dual collet assembly is shifted from the finding position to the running position.

10. The expandable wirefinder as recited in claim 9 wherein the collet fingers of the first collet member form a substantially cylindrical configuration when the dual collet assembly is in the running configuration.

11. The expandable wirefinder as recited in claim 9 wherein each of the collet fingers of the first collet member has an end, wherein the ends substantially form a circular configuration having a diameter substantially the same as a diameter of the sleeve when the dual collet assembly is in the running configuration and wherein the ends substantially form a gapped circular configuration having a diameter larger than the diameter of the sleeve when the dual collet assembly is in the finding configuration.

12. The expandable wirefinder as recited in claim 9 wherein the collet fingers of the second collet member form a substantially cylindrical configuration when the dual collet assembly is in the running configuration.

13. The expandable wirefinder as recited in claim 9 wherein each of the collet fingers of the second collet member has an end, wherein the ends substantially form a circular configuration having a diameter less than a diameter of the sleeve when the dual collet assembly is in the running configuration and wherein the ends substantially form a gapped circular configuration having a diameter larger than the diameter of the sleeve when the dual collet assembly is in the finding configuration.

14. The expandable wirefinder as recited in claim 9 wherein each of the collet fingers of the first and the second collet members has an end and wherein the ends of the collet fingers of the first and the second collet members substantially form a circular configuration having substantially the same diameter when the dual collet assembly is in the finding configuration.

15. The expandable wirefinder as reciited in claim 9 further comprising a fish neck operably associated with the dual collet assembly and operably connectable with a conveying tool that slidably moves the dual collet assembly relative to the sleeve, thereby operating the dual collet assembly between the running and the finding positions.

16. A fishing tool for locating and retrieving a wire downhole comprising:

a sleeve;

an outer collet member having a plurality of outer collet fingers, the outer collet member having a running position and a finding position, in the running position, the outer collet member at least partially disposed within the sleeve with the outer collet fingers inwardly radially biased by the sleeve, in the finding position, the outer collet member not being disposed within the sleeve such that the outer collet fingers radially expand creating gaps therebetween;

an inner collet member having a plurality of inner collet fingers, the inner collet member having a running position and a finding position, in the running position, the inner collet member being disposed within the outer collet member with the inner collet fingers inwardly radially biased by the sleeve, in the finding position, the inner collet fingers radially expanding into the gaps between the outer collet fingers; and a wire grab disposed within the inner collet.

17. The fishing tool as recited in claim 16 wherein the outer collet fingers form a substantially cylindrical configuration when the outer collet member is in the running configuration.

18. The fishing tool as recited in claim 16 wherein each of the outer collet fingers has an end, wherein the ends of the outer collet fingers substantially form a circular configuration having a diameter substantially the same as a diameter of the sleeve when the outer collet member is in the running configuration and wherein the ends of the outer collet fingers substantially form a gapped circular configuration having a diameter larger than the diameter of the sleeve when the outer collet member is in the finding configuration.

19. The fishing tool as recited in claim 16 wherein the inner collet fingers form a substantially cylindrical configuration when the inner collet member is in the running configuration.

20. The fishing tool as recited in claim 16 wherein each of the inner collet fingers has an end, wherein the ends of the inner collet fingers substantially form a circular configuration having a diameter less than a diameter of the sleeve when the inner collet member is in the running configuration and wherein the ends of the inner collet fingers substantially form a gapped circular configuration having a diameter larger than the diameter of the sleeve when the, inner collet member is in the finding configuration.

21. The fishing tool as recited in claim 16 wherein each of the outer and the inner collet fingers has an end and wherein the ends of the outer and the inner collet fingers substantially form a circular configuration having substantially the same diameter when the outer and the inner collet members are in the finding configuration.

22. The fishing tool as recited in claim 16 wherein each of the inner collet fingers has a lug extending radially outwardly therefrom such that when the inner collet member is in the running configuration, the lugs contact the sleeve, thereby inwardly radially biasing the inner collet fingers and such that the inner collet fingers retract before the outer collet fingers when the outer collet member and inner collet member are shifted from the finding position to the running position.

23. The fishing tool as recited in claim 16 wherein relative axial movement between the inner and the outer collet members is prevented.

24. The fishing tool as recited in claim 16 further comprising a fish neck operably associated with the inner and the outer collet members and operably connectable with a conveying tool that axially shifts the inner and the outer collet members relative to the sleeve, thereby operating the inner and the outer collet members between the running and the finding positions.

25. A fishing tool for locating and retrieving a wire downhole comprising:

a sleeve;

a dual collet assembly having first and second collet members each having plurality of collet fingers, the dual collet assembly slidably moveable relative to the sleeve between a running position and a finding position, in the running position, the first collet member at least partially disposed within the sleeve with its collet fingers inwardly radially biased by the sleeve and the second collet member disposed within the first collet member with its collet fingers inwardly radially biased by the sleeve, in the finding position, the collet fingers of the first collet member radially expanded to form gaps therebetween and the collet fingers of the second collet member radially expanded into the gaps; and a wire grab disposed within the dual collet assembly.

26. The fishing tool as recited in claim 25 wherein the collet fingers of the first collet member form a substantially cylindrical configuration when the dual collet assembly is in the running configuration.

27. The fishing tool as recited in claim 25 wherein each of the collet fingers of the first collet member has an end, wherein the ends substantially form a circular configuration having a diameter substantially the same as a diameter of the sleeve when the dual collet assembly is in the running configuration and wherein the ends substantially form a gapped circular configuration having a diameter larger than the diameter of the sleeve when the dual collet assembly is in the finding configuration.

28. The fishing tool as recited in claim 25 wherein the collet fingers of the second collet member form a substantially cylindrical configuration when the dual collet assembly is in the running configuration.

29. The fishing tool as recited in claim 25 wherein each of the collet fingers of the second collet member has an end, wherein the ends substantially form a circular configuration having a diameter less than a diameter of the sleeve when the dual collet assembly is in the running configuration and wherein the ends substantially form a gapped circular configuration having a diameter larger than the diameter of the sleeve when the dual collet assembly is in the finding configuration.

30. The fishing tool as recited in claim 25 wherein each of the collet fingers of the first and the second collet members has an end and wherein the ends of the collet fingers of the first and the second collet members substantially form a circular configuration having substantially the same diameter when the dual collet assembly is in the finding configuration.

31. The fishing tool as recited in claim 25 wherein each of the collet fingers of the second collet member has a lug extending radially outwardly therefrom such that when the dual collet assembly is in the running configuration, the lugs contact the sleeve, thereby inwardly radially biasing the collet fingers of the second collet member and such that the collet fingers of the second collet member retract before the collet fingers of the first collet member when the dual collet assembly is shifted from the finding position to the running position.

32. The fishing tool as recited in claim 25 further comprising a fish neck operably associated with the dual collet assembly and operably connectable with a conveying tool that slidably moves the dual collet assembly relative to the sleeve, thereby operating the dual collet assembly between the running and the finding positions.

33. A method for locating a wire downhole comprising:

running an expandable wirefinder having a sleeve and a dual collet assembly downhole on a conveying device, wherein a first collet member of the dual collet assembly is at least partially disposed within the sleeve that inwardly radially biases collet fingers of the first collet member and wherein a second collet member of the dual collet assembly is disposed within the first collet member with the sleeve inwardly radially biasing collet fingers of the second collet member;

contacting a restriction downhole with the sleeve;

operating the dual collet assembly from the running position to a finding position wherein the collet fingers of the first collet member radially expand to form gaps therebetween and the collet fingers of the second collet member radially expand into the gaps;

proceeding farther downhole with the dual collet assembly in the finding position;

finding the wire downhole;

retrieving the dual collet assembly uphole to the sleeve;

operating the dual collet assembly from the finding position to the running position by retracting the collet fingers of the second collet member before the collet fingers of the first collet member; and retrieving the expandable wirefinder uphole.

34. The method as recited in claim 33 wherein the step of contacting a restriction downhole with the sleeve further comprises the step of locating the sleeve within a downhole nipple.

35. The method as recited in claim 33 wherein the step of operating the dual collet assembly from the running position to the finding position further comprises the step of mechanically disconnecting the dual collet assembly from the sleeve.

36. The method as recited in claim 35 wherein the step of mechanically disconnecting the dual collet assembly from the sleeve further comprises the step of shearing a pin.

37. The method as recited in claim 33 wherein the step of operating the dual collet assembly from the running position to the finding position further comprises the step of expanding the collet fingers of the first and second collet members from a diameter smaller than the restriction to a diameter substantially the same as a diameter of a downhole tubular beyond the restriction wherein the wire is located.

38. The method as recited in claim 37 wherein the step of finding the wire downhole further comprises the step of finding an end of the wire against an inner wall of the tubular and bending the end of the wire away from the inner wall.

39. A method for retrieving a wire from downhole comprising:

running an expandable wirefinder downhole on a conveying device, the expandable wire finder including a sleeve and a dual collet assembly with a wire grab;

contacting a restriction downhole with the sleeve;

operating the dual collet assembly from a running position wherein a first collet member of the dual collet assembly is at least partially disposed within the sleeve such that collet fingers of the first collet member are inwardly radially biased by the sleeve and wherein a second collet member of the dual collet assembly is disposed within the first collet member such that collet fingers of the second collet member are inwardly radially biased by the sleeve to a finding position wherein the collet fingers of the first collet member radially expand to form gaps therebetween and the collet fingers of the second collet member radially expand into the gaps;

proceeding farther downhole with the dual collet assembly in the finding position;

finding the wire downhole with the dual collet assembly;

grabbing the wire with the wire grab;

retrieving the dual collet assembly and the wire uphole to the sleeve;

operating the dual collet assembly from the finding position to the running position; and retrieving the expandable wirefinder and the wire uphole.

40. The method as recited in claim 39 wherein the step of contacting a restriction downhole with the sleeve further comprises the step of locating the sleeve within a downhole nipple.

41. The method as recited in claim 39 wherein the step of operating the dual collet assembly from the running position to the finding position further comprises the step of mechanically disconnecting the dual collet assembly from the sleeve.

42. The method as recited in claim 41 wherein the step of mechanically disconnecting the dual collet assembly from the sleeve further comprises the step of shearing a pin.

43. The method as recited in claim 39 wherein the step of operating the dual collet assembly from the running position to the finding position further comprises the step of expanding the collet fingers of the first and second collet members from a diameter smaller than the restriction to a diameter substantially the same as a diameter of a downhole tubular beyond the restriction wherein the wire is located.

44. The method as recited in claim 43 wherein the step of finding the wire downhole further comprises the step of finding an end of the wire against an inner wall of the tubular and bending the end of the wire away from the inner wall.

45. The method as recited in claim 39 wherein the step of operating the dual collet assembly from the finding position to the running position further comprises retracting the collet fingers of the second collet member before the collet fingers of the first collet member.

* * * * *

UNITED STATES PATENT AND TRADEMARK OFFICE

CERTIFICATE OF CORRECTION

PATENT NO. : 6,848,507 B2
DATED : February 1, 2005
INVENTOR(S) : Huggins et al.

It is certified that error appears in the above-identified patent and that said Letters Patent is hereby corrected as shown below:

Title page,
Item [73], Assignee, "Malliburton Energy Services, Inc." should read -- Halliburton Energy Services, Inc. --.

Signed and Sealed this

Twenty-third Day of August, 2005

JON W. DUDAS
*Director of the United States Patent and Trademark Office*